US006439298B1

(12) United States Patent
Li

(10) Patent No.: US 6,439,298 B1
(45) **Date of Patent: *Aug. 27, 2002**

(54) CYLINDRICAL HEAT RADIATOR

(76) Inventor: Jia Hao Li, No. 2, Lane 127, Dang Ke St., Kang Shan Jen, Kao Hsiung Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/835,514

(22) Filed: Apr. 17, 2001

(51) Int. Cl.[7] ..... F28F 7/00

(52) U.S. Cl. ..... 165/104.33; 165/104.21; 361/700; 257/715; 174/15.2

(58) Field of Search ..... 165/80.3, 104.21, 165/104.33, 104.14, 185, 121, 46; 361/700, 697; 257/715, 722; 174/15.2

(56) References Cited

U.S. PATENT DOCUMENTS

| | | | | | |
|---|---|---|---|---|---|
| 3,269,875 | A | * | 8/1966 | White | 165/185 |
| 4,377,198 | A | * | 3/1983 | Welling et al. | 165/104.33 |
| 4,633,371 | A | * | 12/1986 | Nagy et al. | 165/104.33 |
| 5,390,077 | A | * | 2/1995 | Paterson | 165/104.33 |
| 5,458,189 | A | * | 10/1995 | Larson et al. | 165/46 |
| 5,529,115 | A | * | 6/1996 | Paterson | 165/104.33 |
| 6,019,167 | A | * | 2/2000 | Bishop et al. | 165/104.33 |
| 6,336,497 | B1 | * | 1/2002 | Lin | 165/104.33 |

FOREIGN PATENT DOCUMENTS

| | | | | |
|---|---|---|---|---|
| FR | 1026983 | * | 5/1953 | 165/104.14 |
| JP | 0002985 | * | 1/1982 | 165/104.14 |
| JP | 0095385 | * | 6/1984 | 165/104.21 |

* cited by examiner

*Primary Examiner*—Christopher Atkinson
(74) *Attorney, Agent, or Firm*—Rosenberg, Klein & Lee

(57) ABSTRACT

A cylindrical heat radiator comprises a cylindrical main body having a tightly sealing cavity, the cavity being filled with air; an inner surface of the cylindrical main body being formed with two penetrating channels. The penetrating channels of the cylindrical main body are located with fin sets. The cylindrical main body is formed by an inner tube, an outer tube and sealing rings at two ends. The inner tube and outer tube are arranged non-coaxially. A wick structure is installed in the cavity. By a degassing process, a heat-pipe type heat transferring structure is formed in the cylindrical main body, or by a non-degassing step, a boiling type heat transferring structure is formed. A heat dissipating body being in contact with the cylindrical main body. Fluid in the cylindrical main body is heated to boil and vaporized so that the fluid in the cylindrical main body will flow circularly.

11 Claims, 7 Drawing Sheets

CYLINDRICAL HEAT RADIATOR

FIELD OF THE INVENTION

The present invention relates to a cylindrical heat radiator, and especially to a cylindrical heat radiator with a simpler structure and being capable of dissipating heat naturally.

BACKGROUND OF THE INVENTION

The prior art heat pipe type cooler includes a sealing vacuum cavity. Working fluid is filled in the cavity. A plurality of heat dissipating fins are installed out of the cavity. A wick structure is arranged in the cavity. The principle is that one end of the cavity is heated so that the working fluid will boil or evaporate so as to flow from one side of the cavity to a cold area at another side. Then on the cold area, the vapor is condensed as liquid. Then, by gravity or capillary force, the liquid will flow back.

Due to the limitation of the capillary force in the heat pipe, as too much heat is added, a dry out phenomenon will occur. Namely, more heat is transferred so as to be over the limitation of heat transfer. The returning liquid is insufficient so that the heating area will be a single phase gas, and thus the temperature increases rapidly. Therefore, the heat supper conduction in the heat pipe fails. The heat dissipation is reduced greatly. It is possible that the electronic elements at the heat source will be destroyed due to high temperature from drying out. Due to operation angle of a heat pipe and sensitivity to the deformation of the capillary structure, it can not be operated smoothly.

In the conventional structure, the returning of working fluid and vapor flow are reverse in direction so as to reduce the effect of heat pipe.

Besides, the heat pipe is a slender tube, as illustrated in FIG. 1. Since the heat pipe 1*a* has the advantage of quick heat transfer, while the heat dissipating device for a central processing unit has a rectangular shape and most of the products are made by extrusion process. Namely, the heat dissipating body 2*a* has a bottom to be connected to the central processing unit. The heat dissipating body 2*a* may dissipate the absorbing heat. A plurality of fins 3*a* straightly arranged on the heat dissipating body are used to dissipate heat. At least one heat pipe 1*a* is embedded transversally or extends from the heat dissipating body for assisting heat dissipating. However, those prior art heat dissipating devices have many defects which are necessary to be improved.

SUMMARY OF THE INVENTION

Accordingly, the primary object of the present invention is to provide a cylindrical heat radiator. The cylindrical main body has a preferred heat dissipating property. The received heat will be transferred to the periphery of the cylindrical main body so as to be uniformed. Therefore, heat transfer is optimum in a finite space. By the heat dissipating, a larger heat dissipating is formed.

To achieve the aforesaid object, the present invention provides a cylindrical heat radiator comprising a cylindrical main body having a tightly sealing cavity, the cavity being filled with air; an inner surface of the cylindrical main body being formed with two penetrating channels. The penetrating channels of the cylindrical main body are located with fin sets. The cylindrical main body is formed by an inner tube, an outer tube and sealing rings at two ends. The inner tube and outer tube are arranged non-coaxially. A wick structure is installed in the cavity. By a degassing process, a heat-pipe type heat transferring structure is formed in the cylindrical main body, or by a non-degassing step, a boiling type heat transferring structure is formed. A heat dissipating body being in contact with the cylindrical main body. Fluid in the cylindrical main body is heated to boil and vaporized so that the fluid in the cylindrical main body will flow circularly.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
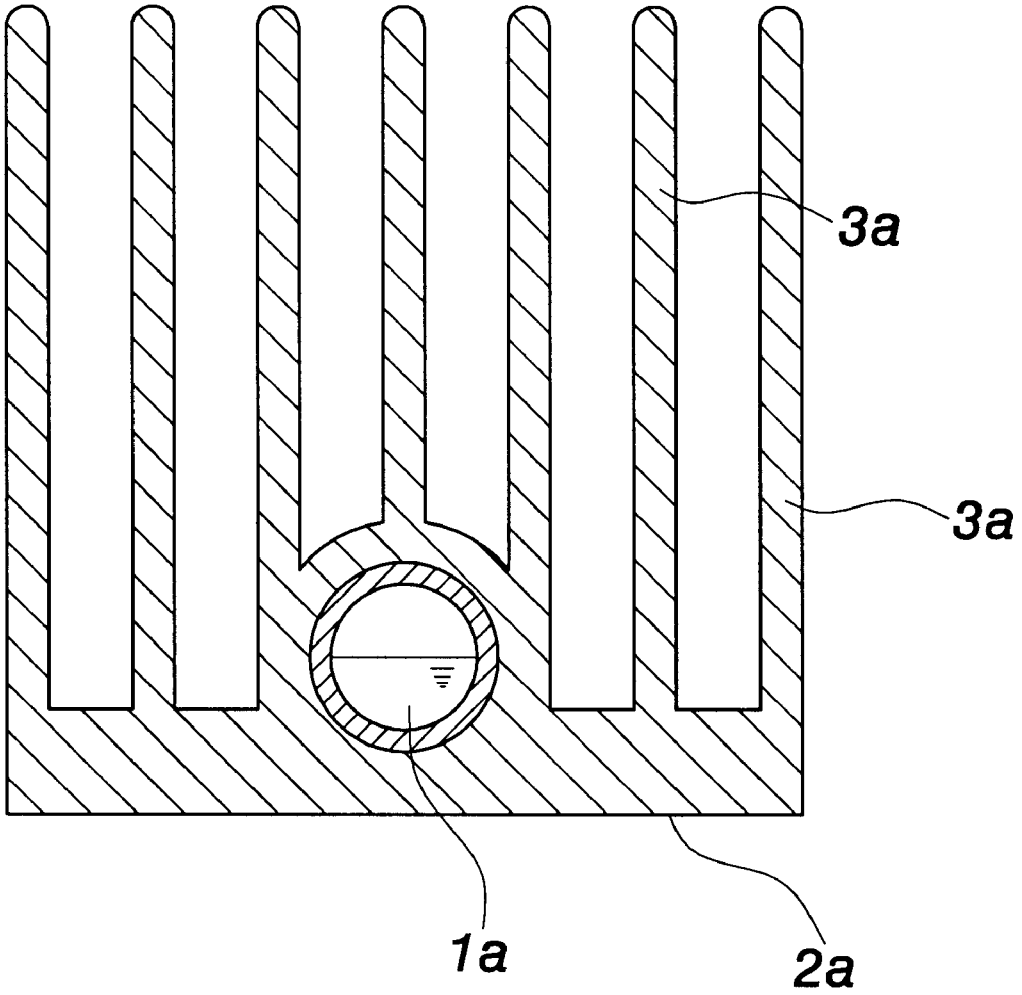
FIG. 1 PRIOR ART
FIG. 1 is a cross sectional view of the prior art.
Figure 2:
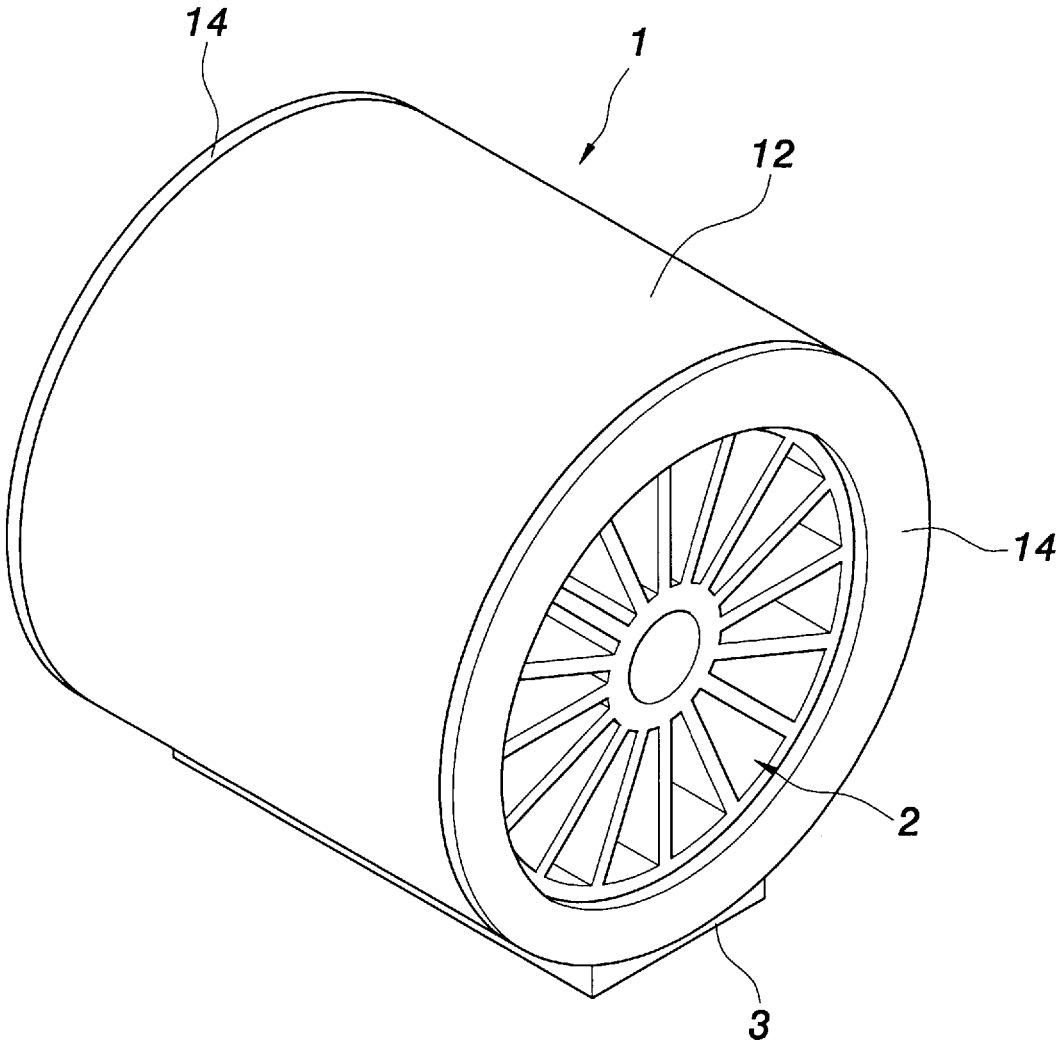
FIG. 2 is a perspective view of the present invention.
Figure 4:
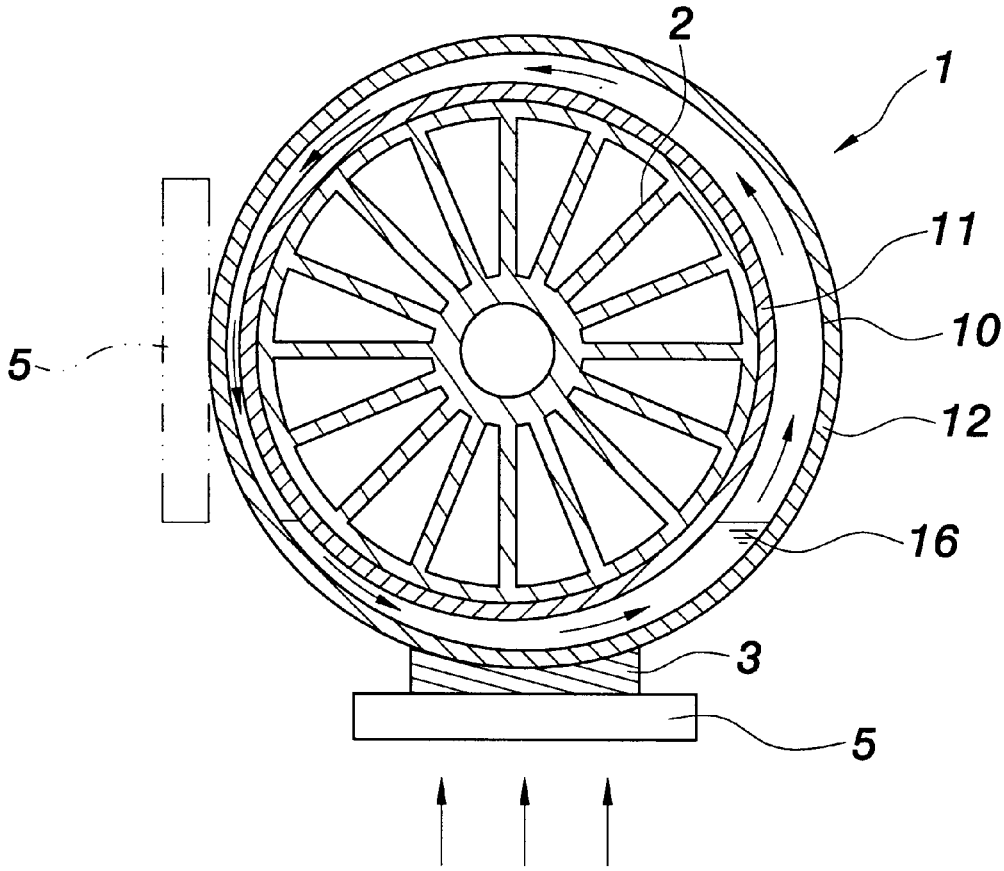
FIG. 4 is an assembled cross sectional view of the present invention.

Referring to FIGS. 2 and 4, the cylindrical heat radiator of the present invention is illustrated. The cylindrical heat radiator has a cylindrical main body 1. A sealing cavity 10 is formed in the cylindrical main body 1. A proper amount of liquid 16 is filled in the cavity 10. The cylindrical main body 1 has an inner tube 11, an outer tube 12, and two sealing rings 14. The inner tube 11 and outer tube 12 are installed coaxially or non-coaxially. The drawings illustrate an embodiment with a non-coaxial installation. At the portion of the sealing rings 14 adjacent to the inner tube 11 and outer tube 12 is installed with a protrusion 15 for being engaged into a gap between two tubes. Since the inner tube 11 is not coaxially installed with respect to the outer tube 12, the protrusion 15 is especially required for positioning the inner tube 11. Two penetrating channels each having an opening 17 are installed at the inner surface 13 of the cylindrical main body 1.

Figure 3:
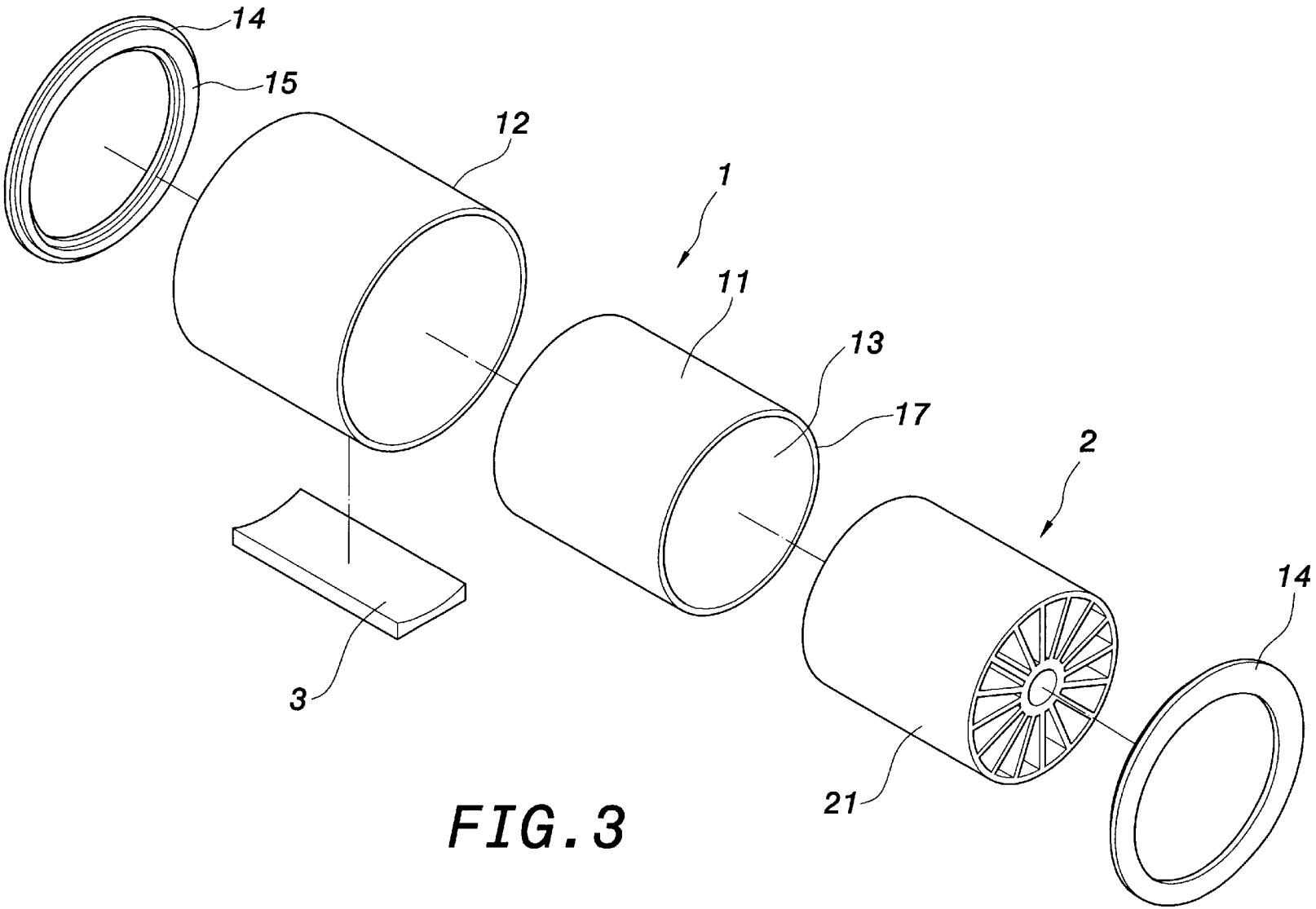
FIG. 3 is an exploded perspective view of the present invention.
Figure 7:
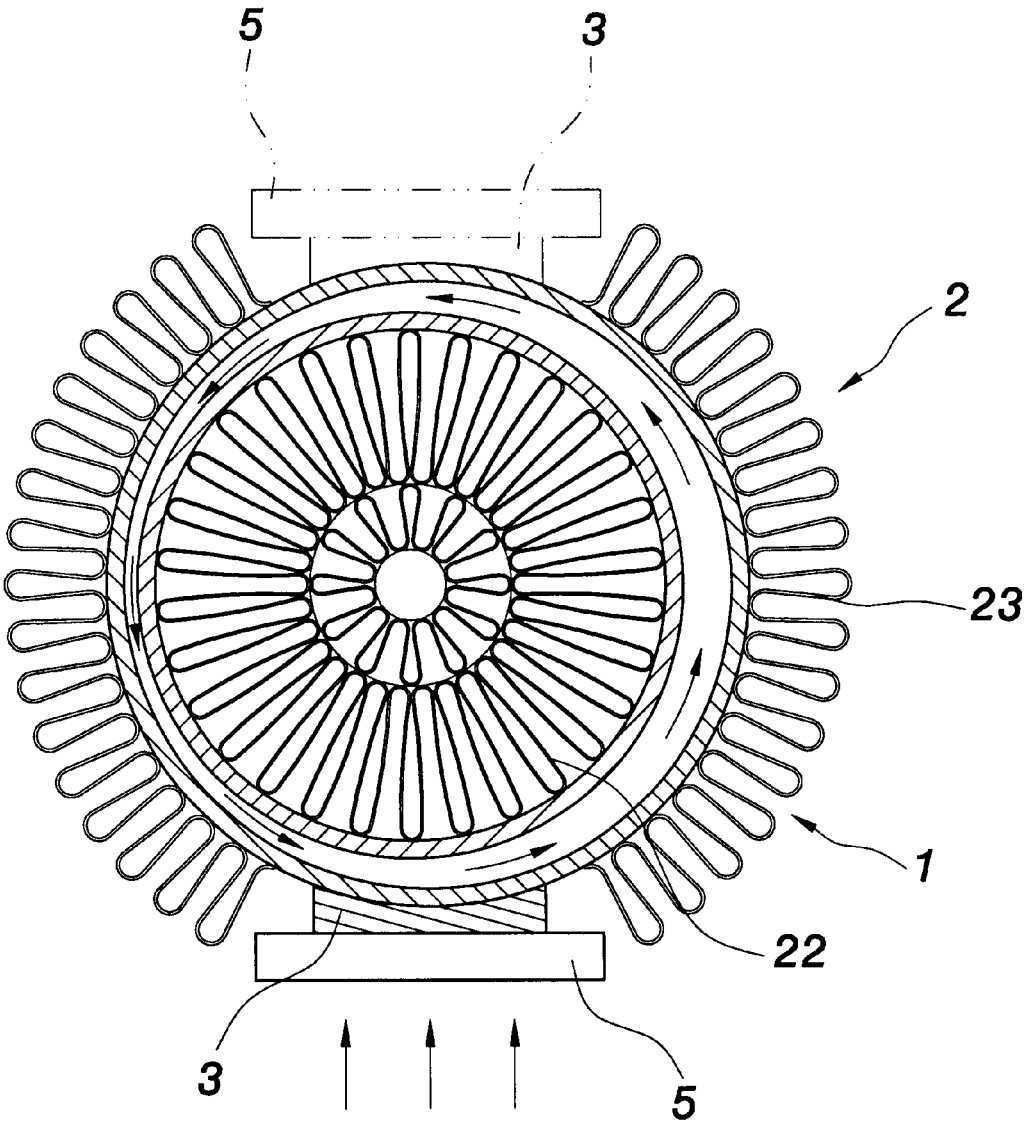
FIG. 7 is an exploded perspective view of another heat radiator in the present invention.

A heat dissipating body 2 is installed, which is capable of contacting the cylindrical main body 1 for having more heat dissipating surfaces. The heat dissipating body may be installed at the penetrating channels interior the inner tube 11 of the cylindrical main body 1 or at the surface of the outer tube 12. As shown in FIG. 3, a fin set 21 is located at the penetrating channel of the cylindrical main body 1. The fin set 21 has a radiating wheel shape and may be formed integrally. The fin sets 22 and 23 may be formed by continuous bending pieces. As shown in FIG. 7, a heat dissipating body 2 with fin sets 22 and 23 at the inner and outer portions of the cylindrical main body 1 is illustrated. The heat dissipating body 2 is installed integrally with the inner tube 11 or outer tube 12 of the cylindrical main body 1.

Figure 5:
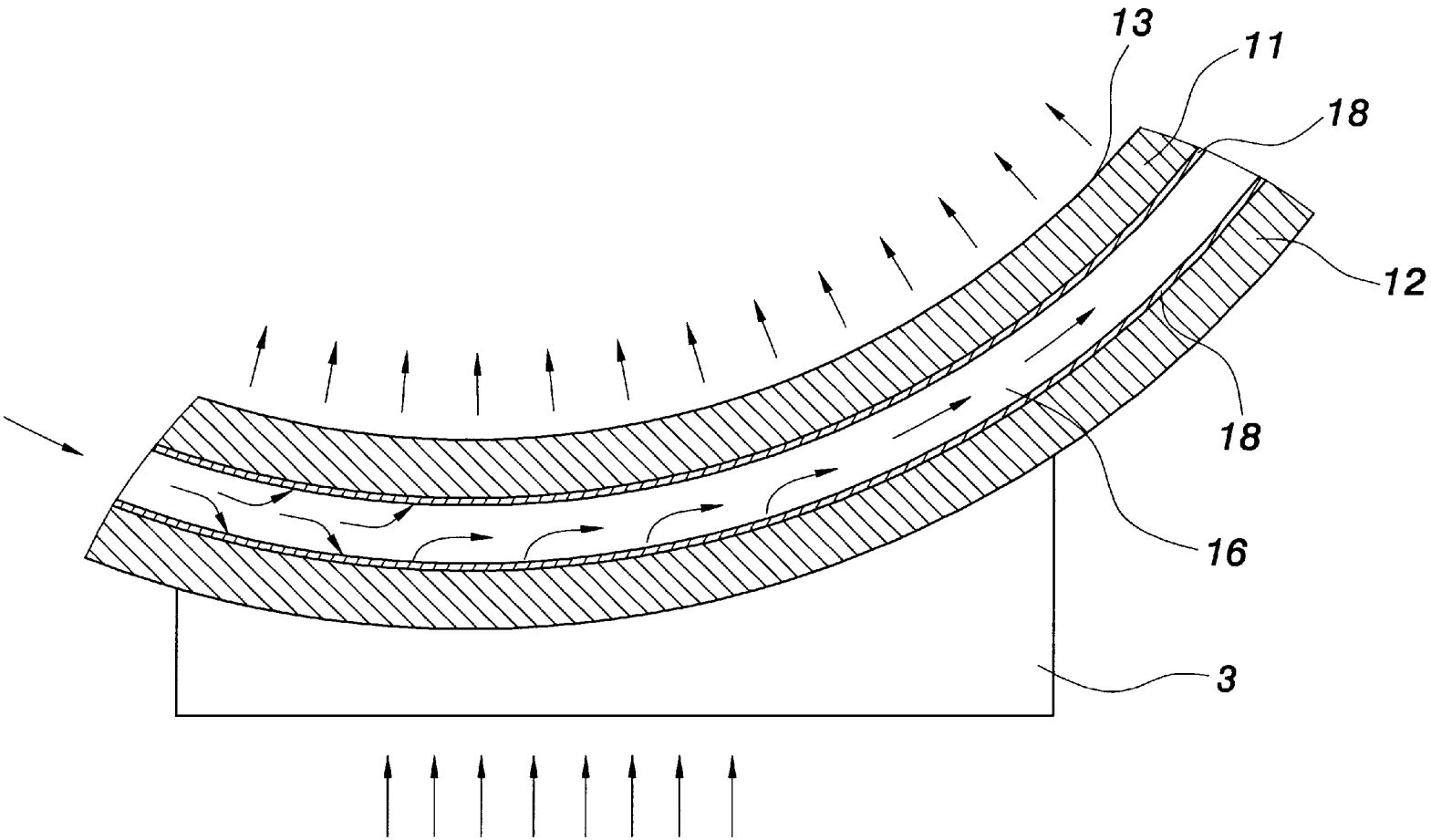
FIG. 5 is a partial enlarged view of the present invention.
Figure 6:
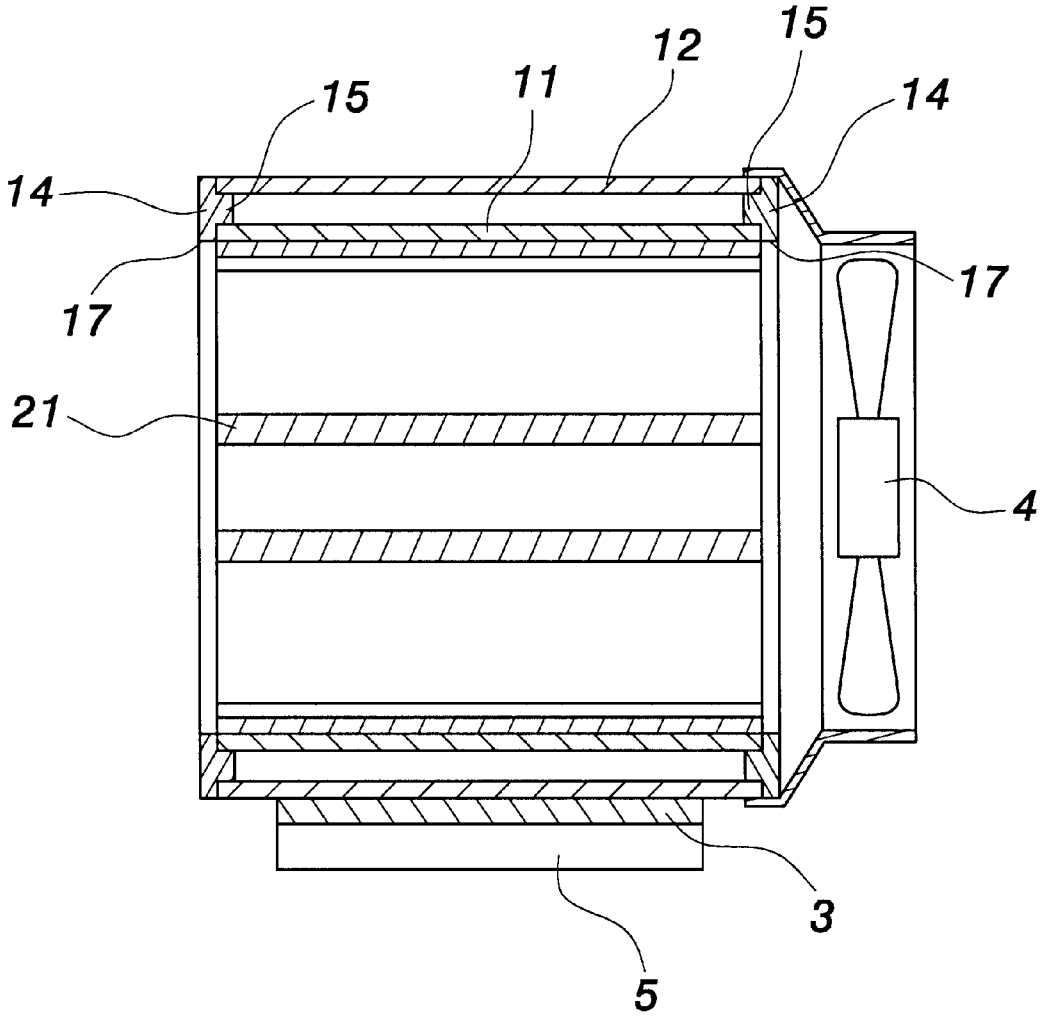
FIG. 6 is a cross sectional view showing that a fan is further added to the present invention.

As shown in FIG. 5, a wick structure 18 is formed in the cavity 10. By a degassing process, a heat-pipe type heat transferring structure is formed in the cylindrical main body 1, or by a non-degassing step, a boiling type heat transferring structure is formed. These two structures are basic forms of the present invention. Referring to FIGS. 5 and 7, the cylindrical main body 1 may be connected to a heat source 5 through at least one heat conductive block 3. Furthermore, as shown in FIG. 6, one end of the cylindrical main body 1 may be connected to a fan so as to enhance the effect of the present invention, in increasing the amount of heat dissipation and reducing heat dissipation time.

Since in the aforesaid embodiment, a cylinder is used as an example. However, the cylindrical main body may be changed to the desired cross section, such as round shape, rectangular shape, elliptical shape or polygonal shapes. Further, as shown in FIG. 5, if the heat conductive block 3 is shifted aside, then a side is thinner and another side is thicker. Thus, the liquid in the cavity 10 will form a circulation along a specific direction. Since the heat from the heat source 5 is transferred to the cylindrical main body 1 through the heat conductive block 3 directly or indirectly (as the dashed lines illustrated in FIG. 4) so that the liquid 16 flows because the heat from the outer tube 12, as shown in FIG. 5. Then, the heat is transferred to the inner tube 11 to the fin sets of the heat dissipating body 2 for dissipating heat. The heat dissipating body thus dissipates heat rapidly and greatly.

In summary, in the present invention, liquid in the hollow cylindrical main body is used in the present invention. The liquid fills all the holes in the wick structure or 90% space of the cavity so that the fluid formed by the vapor flow and condensed fluid flow flows in the same directions. The larger the heat transfers, the quicker the flow of the fluid and the more uniform the air in the cavity. More heat is exchanger and the speed of the fluid is quicker. No dry out will occurs. The circulation of the fluid is retained at all time and thus preferred heat conduction is provided. Furthermore, the heating position of the cylindrical main body is at the narrow portion of the shifted cavity so that the fluid flows toward a fixed single direction. The fluid may flow easily and a single direction flow is easily formed.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A cylindrical heat radiator comprising:

a cylindrical main body having a tightly sealed cavity defined therein, said cylindrical body being formed by an outer tube having an axially directed first through bore and an inner tube asymmetrically disposed in said first through bore to define said cavity therebetween, said cavity having an eccentric annular cross-sectional contour and being filled with a predetermined quantity of a working fluid, said inner tube having an axially directed second through bore extending therein; and a heat dissipating body disposed in said second through bore and being in thermal contact with said inner tube for forming a larger heat dissipating surface;

wherein heat coupled to said outer tube is transferred to said heat dissipating body by heating said working fluid in said cavity to boil and vaporize so that said vapor and a condensate flow circularly in a single predetermined direction.

2. The cylindrical heat radiator as claimed in claim 1, wherein said cylindrical main body further includes a pair of sealing rings respectively disposed at two opposing ends thereof, said pair of sealing rings being coupled to said outer tube and supporting said inner tube asymmetrically within said first through bore.

3. The cylindrical heat radiator as claimed in claim 1, wherein a wick structure is disposed on an external surface of said inner tube and an internal surface of said outer tube.

4. The cylindrical heat radiator as claimed in claim 1, wherein said cylindrical main body is connected to at least one heat source through a heat conductive block.

5. The cylindrical heat radiator as claimed in claim 1, wherein said heat dissipating body is formed by a pair of fin sets, said pair of fin sets being respectively disposed in said second through bore of said inner tube and on an external surface of said outer tube.

6. The cylindrical heat radiator as claimed in claim 1, wherein said heat dissipating body has a continuous folding shape.

7. The cylindrical heat radiator as claimed in claim 1, wherein said heat dissipating body is integrally formed with said inner tube.

8. The cylindrical heat radiator as claimed in claim 1, wherein said cylindrical main body has a cross-sectional contour selected from the group consisting of a round shape, a rectangular shape, an elliptical shape and a polygonal shape.

9. The cylindrical heat radiator as claimed in claim 1, further comprising a fan coupled to one end of said cylindrical main body for enhancing heat dissipation therefrom.

10. The cylindrical heat radiator as claimed in claim 1, wherein said heat dissipating body is formed by a first fin set disposed in said second through bore of said inner tube.

11. The cylindrical heat radiator as claimed in claim 10, wherein said heat dissipating body is further formed by a second fin set disposed on an external surface of said outer tube.

* * * * *